United States Patent [19]

Diard et al.

[11] Patent Number: 4,911,462

[45] Date of Patent: Mar. 27, 1990

[54] CROSS COUNTRY SKI

[75] Inventors: Jean-Luc Diard; Gilles Recher; Philippe Grandjacques, all of Annecy, France

[73] Assignee: Salomon S.A., Annecy, France

[21] Appl. No.: 147,278

[22] Filed: Jan. 22, 1988

[30] Foreign Application Priority Data

Feb. 5, 1987 [FR] France ..... 87 01419

[51] Int. Cl.[4] ..... A63C 5/00

[52] U.S. Cl. ..... 280/607; 280/610

[58] Field of Search ..... 280/607, 609, 610, 614, 280/615, 601

[56] References Cited

U.S. PATENT DOCUMENTS

| | | | |
|---|---|---|---|
| 2,362,380 | 4/1943 | Kallstrom et al. | 280/610 |
| 2,560,693 | 7/1951 | Hickman | 280/610 |
| 2,695,178 | 11/1954 | Rheinfrank, Jr. | 280/610 |
| 3,414,279 | 12/1968 | Allain | 280/610 |
| 4,094,528 | 6/1978 | Cluzel | 280/610 |
| 4,335,531 | 6/1982 | Salomon | 36/117 |
| 4,487,427 | 12/1984 | Salomon | 280/615 |
| 4,681,725 | 7/1987 | Maruyama | 280/610 |
| 4,714,267 | 12/1987 | Abondance et al. | 280/615 |

FOREIGN PATENT DOCUMENTS

| | | | |
|---|---|---|---|
| 84816 | 3/1965 | France | 280/610 |
| 1423868 | 11/1965 | France | 280/610 |
| 87478 | 7/1966 | France | 280/610 |
| 2130793 | 11/1972 | France . | |
| 2565117 | 12/1985 | France . | |
| 0152918 | 2/1932 | Switzerland . | |
| 0233402 | 7/1944 | Switzerland . | |
| 0288757 | 6/1953 | Switzerland . | |

*Primary Examiner*—Charles A. Marmor
*Assistant Examiner*—Michael Mar
*Attorney, Agent, or Firm*—Sandler & Greenblum

[57] ABSTRACT

Cross country ski comprising an upper longitudinal rib having a generally vertical trapezoid cross section. The longitudinal rib has at least two superimposed layers extending to form the upper base, and two sides of the trapezoid.

29 Claims, 1 Drawing Sheet

CROSS COUNTRY SKI

BACKGROUND OF THE INVENTION

1. Field of the Invention

The present invention relates to a cross country ski having a longitudinal rib projecting upwardly with respect to its upper surface.

2. Description of Background In Relevant Information

Cross country skis are known which comprise a longitudinal rib along their upper surface. This longitudinal rib generally has a vertical trapezoidal cross section, i.e., it is defined by an upper horizontal surface and two lateral inclined surfaces. The rib, having a vertical trapezoidal cross section, is connected to the lower portion of the ski which has a right rectangular cross section, of short height, whose short sides constitute the edges of the ski. By virtue of the reduced height of the edges, such a cross country ski slides more easily on the snow. Furthermore the upper longitudinal rib contributes to the lateral guidance of the boot mounted on the cross country ski, which is adapted for this purpose by virtue of the provision, in its sole, of a groove having in vertical cross section of a shape complementary to that of the ski rib.

A cross country ski of this type is constituted by a beam casing whose wall, shaped in the manner noted above, is formed of a layered or reinforced plastic material, e.g., reinforced by carbon or glass fiber, whose interior is filled with a relatively rigid but light material such as a rigid foam.

The present invention relates to improvements applied to such a cross country ski having as an aim to improve its resistance, particularly during the practice of skating "in half skating steps", without substantially increasing its weight.

SUMMARY OF THE INVENTION

It is, therefore, an object of the invention to provide a cross country ski comprising an upper longitudinal rib having a generally vertical trapezoid cross section. The longitudinal rib comprises at least two superimposed layers extending to form the upper base, and two sides of the trapezoid.

The superimposed layers are distinct and are joined to one another. The ski is formed as a casing beam whose lower wall constitutes the sole of the ski. The internal volume of the may be hollow, or be filled with a rigid lightweight material such as a rigid foam.

Each of the two superimposed layers is in the form of a shaped element, whereby one of the shaped elements is an external shaped element, and the other of the shaped elements is an internal shaped element; the internal shaped element being nested within the external shaped element. Each of the internal and external shaped elements is nested at its upper portion. The internal shaped element together with the lower wall defines a trapezoidal volume. Only the upper portion of the external shaped element joined to the internal shaped element defines an internal volume having a vertical trapezoidal cross section. The remainder of the external shaped element generally defines an internal volume having a vertical rectangular cross section. The remainder of the external shaped element comprises two upper generally horizontal wall portions, two vertical wall sections forming the edges of the ski, and a horizontal bottom wall.

In one embodiment the external shaped element and the upper portion of the internal shaped element each generally enclose a volume in the form of an isosceles trapezoid. In one variation of this embodiment the longitudinal plane of symmetry of the internal and external shaped elements coincides with the vertical longitudinal median plane of the ski. In another variation of the same embodiment the longitudinal plane of symmetry of the internal and external shaped elements is offset towards the interior of the ski with respect to the vertical and longitudinal median plane of the ski.

In another embodiment the vertical cross section of the volume defined by the internal and external shaped elements is in the form of a non-isosceles trapezoid In one variation of this embodiment each of the internal and external shaped elements has inclined lateral walls, the inclined lateral walls on the interior side of the ski being more vertically oriented than the inclined lateral walls on the exterior side of the ski.

In yet another embodiment of the invention the internal shaped element is formed of two distinct sections transversely spaced from one another, each of the distinct sections comprises upper horizontal wings extending towards one another, and inclined lateral walls extending towards the sole of the ski. Each of the inclined lateral walls ends at its bottom in a lower horizontal wing in contact with the upper surface of the of the ski. In one variation of this embodiment each of the horizontal wings further extend upwardly in contact with the corresponding internal surface of the edges of the ski. In another variation one of the horizontal wings extends towards the interior of the ski.

The ski may further comprise a lower shaped element for rigidifying the internal shaped element. The lower shaped element may have an open polygonal vertical cross section including a lower horizontal surface in contact with the upper surface of the sole, and outwardly inclined lateral walls extending upwardly and laterally from the lateral edges of the lower horizontal surface until reaching the corresponding laterally inclined wall of the internal shaped element. Each of the inclined lateral walls ends in flaps inclined upwardly and inwardly and are in contact with the internal surfaces of the inclined walls, and are joined thereto.

An exterior layer shaped to closely conform to the exterior surface of the external shaped element may also be provided. Furthermore, a sliding underlayer mounted beneath the sole of said ski, said underlayer extending upwardly along the edges of said ski. The sole of the ski may extend upwardly along each of the edges of the ski in contact with the lower portion of the external surface of each edge.

BRIEF DESCRIPTION OF THE DRAWINGS

The invention will now be described with reference to a number of non-limiting examples of various embodiments of the present invention given with reference to the annexed drawings in which.

DESCRIPTION OF PREFERRED EMBODIMENTS

The cross country ski according to the invention has an upper rib with respect to the upper surface and has a vertical trapezoidal cross section, this cross country ski being constituted by a beam casing whose lower wall is constituted by the sole of the ski and whose internal volume is empty or filled with a relatively rigid, but light material such as a rigid foam. The ski is characterized in that the longitudinal rib is formed by at least two distinct joined layers which constitute the two lateral inclined surfaces and the horizontal upper surface of the rib.

According to a complementary characteristic of the invention the casing beam of the ski is constituted by two internal and external shaped elements or members nested within one another at their upper trapezoidal portions (bases), the volume enclosed by the internal shaped element having a totally vertical trapezoidal cross section while only the upper portion of the external shaped element has a vertical cross section in the form of a trapezoid The upper portion of the external shaped element tightly mates with the upper portion of the vertical trapezoidal cross section of the internal shaped element. The upper portion of the external shaped element is extended, on each side of the guidance rib, into a horizontal wing then into a vertical wall constituting the edges of the ski which extend downwardly until the sole thereof to which they are perpendicularly connected.

The vertical cross section of the two internal and external shaped elements constituting the beam casing can have the shape of an isosceles or non-isosceles trapezoid. In this latter case the more inclined side with respect to the horizontal is situated on the exterior side of the ski.

The internal shaped element can be formed out of a single element or out of two longitudinal elements, parallel and spaced from one another.

Figure 1:
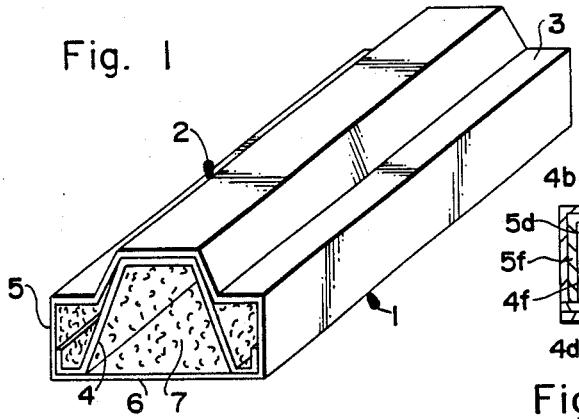
FIG. 1 is a perspective view of a cross country ski having a longitudinal rib according to the invention.
Figure 2:
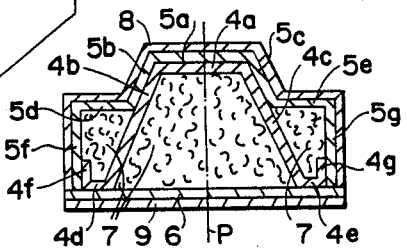
FIG. 2 is a vertical and transverse cross sectional view of the cross country ski of FIG. 1.
Figure 3:
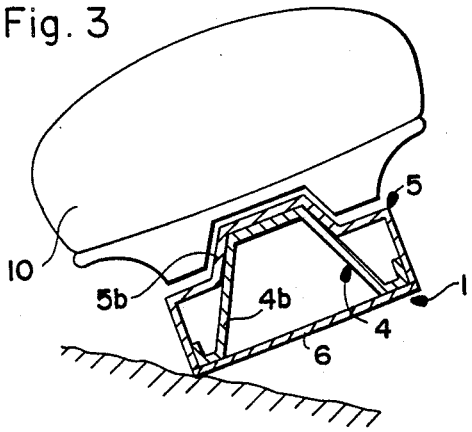
FIG. 3 is a vertical and transverse cross sectional view of the cross country ski of FIG. 1 as it is stressed during the practice of "skating"

Cross country ski 1 according to the invention which is shown in FIGS. 1–3, comprises a longitudinal rib 2 which projects upwardly with respect to the upper surface 3 of the ski. Rib 2 which has a vertical trapezoidal cross section, is constituted, according to the invention, by two joined layers of plastic material, which contributes to its reinforcement. These two layers, formed of the same plastic material or out of different plastic materials are made to adhere to one another by any known process, such as by gluing. More particularly ski 1 is constituted by a beam casing itself formed by two longitudinal shaped elements made of plastic material nested within one another, i.e., an internal shaped element 4 and an external shaped element 5. These two shaped elements are symmetrical with respect to the vertical and longitudinal median plane P of the ski so that the vertical cross section of rib 2 has the shape of an isosceles trapezoid. The beam casing is closed at its lower portion by a horizontal sole 6 to which the two shaped elements 4 and 5 are connected. The internal volumes defined by the two shaped elements 4 and 5 and the sole 6 can be empty, if the thickness of the shaped elements 4 and 5 and of the sole 6 is sufficiently large so as to give the desired rigidity to the ski, or they may be filled with a relatively rigid but light material 7 such as a rigid or semi-rigid foam.

As can better be seen in FIG. 2, the internal shaped element 4 comprises an upper horizontal wall 4*a* which is extended downwardly by two lateral inclined walls 4*b* and 4*c* which are extended in turn, at their lower ends, by horizontal wing sections 4*e* and 4*d* extending towards the exterior, in contact with the upper surface of sole 6, and which end in edges 4*f* and 4*g* extending upwardly. The external shaped element 5 comprises in the same manner an upper trapezoidal portion constituted by an upper horizontal wall 5*a* which is extended downwardly by two lateral inclined walls 5*b* and 5*c*. The dimensions of the walls 5*a*, 5*b*, 5*c* and the inclinations of the lateral walls 5*b* and 5*c* are selected such that the upper trapezoidal portion of the external shaped element 5 tightly caps that of the internal shaped element 4 and adheres thereto. Walls 5*a*, 5*b*, 5*c* are thus joined to respective walls 4*a*, 4*b*, 4*c*. Inclined walls 5*b*, 5*c* of external shaped element 5 do not extend over the entire width of inclined walls 4*b* and 4*c* of the internal shaped element 4 and at their lower ends, they extend into horizontal wings 5*d* and 5*e* which extend towards the exterior, which are in turn extended by vertical walls 5*f* and 5*g* downwardly until the sole 6. Walls 5*f* and 5*g* constitute the edges of the ski. Edges 4*f* and 4*g* of internal shaped element 4 are pressed against the lower portions of the internal surfaces of the edges 5*f* and 5*g*. Filling material 7 totally fills the different internal volumes, namely the central volume defined between the internal shaped element 4 and the sole 6 and the two lateral volumes defined between internal shaped element 4 and external shaped element 5.

Preferably external shaped element 5 is covered with an outward layer 8 whose contour closely follows that of the external shaped element 5. Furthermore, sole 6 carries on its exterior an underlayer 9 made of a material which facilitates sliding, for example polyethylene.

FIG. 3 illustrates the manner in which the lining of the longitudinal rib intervenes for the reinforcement of the ski during the "skating" procedure. In this case ski 1 serves to give a push off impulse and is inclined with respect to the ground, and that the force F exerted in this case by a ski boot 10 is applied substantially in the junction plane of the lateral inclined surfaces 4*b* and 5*b* joined to one another, of the two shaped elements 4 and 5. Thus, this junction zone is particularly reinforced and better resists forces F.

Figure 4:
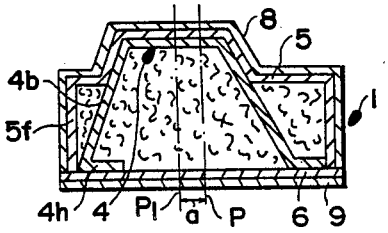
FIGS. 4,5,6,7 and 8 are transverse cross sectional views illustrating various alternative embodiments.

In the embodiment shown in FIG. 4 the vertical and longitudinal plane of symmetry $P_1$ of internal shaped element 4 and external shaped element 5 is offset on one side, by distance a, with respect to the vertical and longitudinal median plane P of ski 1 in its entirety. This offset occurs on the side where the ski inclined with respect to the movement axis is supported on the snow during the skating half step, i.e., on the interior side of the ski. On this side one can likewise see in FIG. 4 that the left inclined wall 4*b* of internal shaped element 4 ends in a wing 4*h* which extends towards the interior, while being in contact with sole 6. As a result, the edge of the dihedral formed by inclined wall 4*b* and wing 4*h* is positioned in the angle formed by the left edge 5*f* and sole 6.

Figure 5:
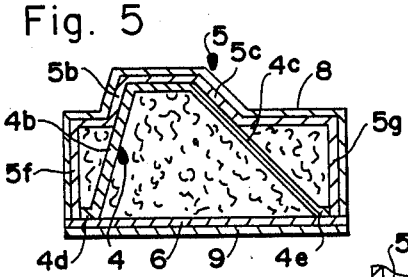

In the alternative embodiment shown in FIG. 5 internal shaped element 4 and external shaped element 5 have upper portions which have vertical cross sections in the form of a non-isosceles trapezoid. In this case the left lateral inclined walls 4*b* and 5*b* of the two shaped elements 4 and 5 which are on the interior side of the ski, are preferably more inclined with respect to the horizontal plane than are the other inclined walls 4c and 5c. In this alternative embodiment the internal shaped element 4 is connected by its lower horizontal wings 4d and 4e of short width, directly to the internal surfaces of the two edges 5f and 5g.

Figure 6:
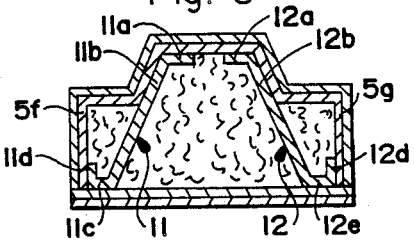

In the embodiment of the invention shown in FIG. 6 which is similar to that of FIG. 2, the internal shaped element is formed by two distinct sections 11 and 12 which are transversely spaced from one another, by providing a separation in the central portion of the upper horizontal wall 4a of the internal shaped element 4 of FIG. 2. The shaped element sections 11 and 12 thus comprise respective upper horizontal wings 11a and 12a extending towards one another and lateral inclined walls 11b and 12b extending until sole 6. These inclined walls 11b and 12b terminate at their lower ends, in horizontal wings 11c and 12c extending towards the exterior, in contact with sole 6, and ultimately extended upwardly by vertical edge portions 11dand 12d in contact with edges 5f and 5g.

Figure 7:
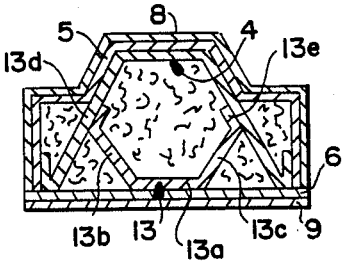

In the embodiment of the invention shown in FIG. 7 the cross country ski comprises a third lower shaped element 13 serving to rigidify the internal shaped element 4. This lower shaped element 13 has an open polygon vertical cross section and comprises a lower horizontal base 13a, in contact with the upper surface of sole 6, and two lateral wing portions upwardly inclined towards the exterior 13b, 13c, which extend until coming into contact with the inclined lateral walls 4b and 4c of the internal shaped element 4. The inclined wings 13b and 13c end in turn in flaps 13d and 13e which are inclined upwardly and towards the interior and which are in contact with the internal surfaces of the inclined walls 4b and 4c to assure the linkage therewith.

Figure 8:
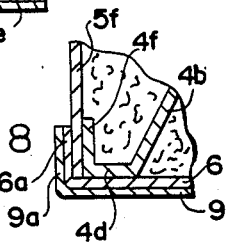

In the embodiment of the invention shown in FIG. 8 sole 6 is extended upwardly, at each of its lateral ends, into an edge 6a which extends into contact with the lower portion of the external surface of edge 5f. Sliding underlayer 9 is likewise extended upwardly to form an external edge 9 to cover edge 6a of sole 6.

Although the invention has been described with reference to particular means, materials and embodiments, it is to be understood that the invention is not limited to the particulars disclosed and extends to all equivalents within the scope of the claims.

We claim:

1. A cross country ski comprising an upper longitudinal rib having a generally vertical trapezoid cross-section, said trapezoid cross-section having an upper base, said longitudinal rib comprising at least two superimposed layers extending to form the upper base and two sides of said trapezoid, wherein said superimposed layers are distinct and are joined to one another, wherein said ski is formed as a casing beam whose lower wall constitutes the sole of the ski, wherein each of said two superimposed layers is in the the form of a shaped element, whereby one of the shaped elements is an external shaped element, and the other of said shaped elements is an internal shaped element, said internal shaped element being nested within said external shaped element, wherein each of said internal and external shaped elements is in nesting engagement at its upper portion, wherein said internal shaped element together with said lower wall defines a trapezoid volume, wherein only the upper portion of said external shaped element joined to said internal shaped element defines an internal volume having a vertical trapezoid cross-section wherein the remainder of said external shaped element generally defines an internal volume having a vertical rectangular cross-section, and wherein said remainder of said external shaped element comprises two upper generally horizontal wall portions extending from the two sides of said trapezoid, a horizontal bottom wall, and two vertical wall sections extending between the horizontal wall portions and the horizontal bottom wall and forming the sides of the ski.

2. The cross section as defined by claim 1 wherein the external shaped element and the upper portion of the internal shaped element each generally enclose a volume in the form of an isosceles trapezoid.

3. The cross country ski as defined by claim 2 wherein the longitudinal plane of symmetry of the internal and external shaped elements coincides with the vertical longitudinal median plane of the ski.

4. The cross country ski as defined by claim 2 wherein the longitudinal plane of symmetry of the internal and external shaped elements is offset towards the interior of the ski with respect to the vertical and longitudinal median plane of the ski.

5. The cross country ski as defined by claim 1 wherein the vertical cross section of the volume defined by said internal and external shaped elements is in the form of a non-isosceles trapezoid.

6. The cross country ski as defined by claim 5 wherein each of said internal and external shaped elements has inclined lateral walls, the inclined lateral walls on the interior side of the ski being more vertically oriented than the inclined lateral walls on the exterior side of the ski.

7. A cross-country ski comprising an upper longitudinal rib for laterally guiding a boot on said cross-country ski, said upper longitudinally extending rib having a cross-sectional shape generally in the form of a trapezoid, said ski having a sole, side edge surfaces and upper substantially horizontal surfaces, said upper longitudinal rib projecting from said upper surfaces, said longitudinal rib comprising at least two superimposed layers which form an upper base and sides of said trapezoid, wherein said two superimposed layers are distinct from one another, wherein said two superimposed layers comprise at least portions of an external shaped element and an internal shaped element, said internal shaped element being in nesting engagement within said external shaped element at least with respect to the upper base and sides of said trapezoid, said internal shaped element extending downwardly from said ribbed portion and further including lower portions which are supported by said sole, said external shaped element further comprising side walls which comprise said side edge surfaces and which extend from said sole to said upper substantially horizontal surfaces, said internal element being spaced from said side walls which define respective internal volumes with said ski side walls.

8. The cross country ski as defined by claim 7 wherein said ski is formed as a casing beam having a lower wall constituted by said sole of said ski.

9. The cross country ski as defined by claim 8 wherein the internal volume of said ski is hollow.

10. The cross country ski as defined by claim 8 wherein the internal volume of said ski is filled with a rigid lightweight material.

11. The cross country ski as defined by claim 10 wherein said rigid lightweight material is a rigid foam.

12. The cross country ski as defined by claim 8 wherein said internal shaped element together with said sole defines a trapezoidal volume.

13. The cross country ski as defined by claim 12 wherein only the upper portion of said external shaped element joined to said internal shaped element defines an internal volume having a vertical trapezoidal cross section.

14. The cross country ski as defined by claim 13 wherein the remainder of said external shape element generally defines an internal volume having a vertical rectangular cross section.

15. The cross country ski as defined by claim 8 wherein said internal shaped element is formed of two distinct sections transversely spaced from one another, each of said distinct sections comprising upper horizontal wings extending towards one another, and inclined lateral walls extending towards said sole of said ski.

16. The cross country ski as defined by claim 15 wherein each of said inclined lateral walls ends at its bottom in a lower horizontal wing in contact with the upper surface of said sole of said ski.

17. The cross country ski as defined by claim 16 wherein each of said horizontal wings further extend upwardly in contact with the corresponding internal surface of said side walls of said ski.

18. The cross country ski as defined by claim 16 wherein one of the horizontal wings extends towards the interior of the ski.

19. The cross country ski as defined by claim 7 further comprising a lower shaped element for rigidifying said internal shaped element.

20. The cross country ski as defined by claim 19 wherein said lower shaped element has an open polygonal vertical cross section including a lower horizontal surface in contact with the upper surface of the sole, outwardly inclined lateral walls extending upwardly and laterally from the lateral edges of said lower horizontal surface until reaching the corresponding laterally inclined wall of said internal shaped element, each of said inclined lateral walls ending in flaps inclined upwardly and inwardly and being in contact with the internal surfaces of the inclined walls, and being joined thereto.

21. The cross country ski as defined by claim 7 further comprising an exterior layer shaped to closely conform to the exterior surface of said external shaped element.

22. The cross country ski as defined by claim 7 further comprising a sliding underlayer mounted beneath said sole of said ski, said underlayer extending upwardly along the edges of said ski.

23. The cross country ski as defined by claim 22 wherein the sole of said ski extends upwardly along each of the edges of the ski in contact with the lower portion of the external surface of each edge.

24. A cross-country ski comprising:

(a) an external shaped element comprising:
  (i) a longitudinal extending external rib having an upper substantially horizontal wall and a pair of rib side walls;
  (ii) ski upper surface extending generally laterally from said longitudinally extending external rib; and
  (iii) a ski side wall extending generally downwardly from each of said ski upper surfaces;

(b) a lower substantially horizontal wall extending between said side walls; and (c) an internal shaped element located within said external shaped element, said internal shaped element comprising a pair of inclined walls extending from proximate said lower wall of said ski to said upper wall of said longitudinally extending rib and being in nesting engagement with said rib side walls, said pair of inclined walls of said internal shaped element further including portions spaced from said ski side walls and which define respective internal volumes with said ski side walls.

25. The cross-country ski of claim 24 wherein said internal volumes are empty.

26. The cross-country ski of claim 24, further comprising a relatively rigid or semi-rigid lightweight material in said internal volumes.

27. The cross-country ski of claim 26 wherein said lightweight material is a foam material.

28. The cross-country ski of claim 24 further comprising an exterior layer adjacent to said external shaped element.

29. The cross-country ski of claim 24 wherein said internal shaped element has a trapezoidal cross-section and only an upper portion of said external shaped element has a trapezoidal cross-section within which an upper portion of said internal shaped element is nested.

* * * * *